US008091400B2

(12) United States Patent
Binhack

(10) Patent No.: US 8,091,400 B2
(45) Date of Patent: Jan. 10, 2012

(54) DEVICE AND METHOD FOR FORMING A WORKPIECE

(75) Inventor: Fritz Binhack, Bretten-Ruit (DE)

(73) Assignee: Felss GmbH, Koenigsbach-Stein (DE)

( * ) Notice: Subject to any disclaimer, the term of this patent is extended or adjusted under 35 U.S.C. 154(b) by 404 days.

(21) Appl. No.: 12/309,949

(22) PCT Filed: Jul. 12, 2007

(86) PCT No.: PCT/EP2007/006174

§ 371 (c)(1),
(2), (4) Date: Feb. 4, 2009

(87) PCT Pub. No.: WO2008/017358

PCT Pub. Date: Feb. 14, 2008

(65) Prior Publication Data

US 2009/0188292 A1 Jul. 30, 2009

(30) Foreign Application Priority Data

Aug. 7, 2006 (DE) ..... 10 2006 037 091
Aug. 7, 2006 (DE) ..... 20 2006 012 170 U

(51) Int. Cl.
*B21C 23/00* (2006.01)

(52) U.S. Cl. ..... 72/273.5; 72/253.1; 72/271

(58) Field of Classification Search ..... 72/273.5, 72/253.1, 271, 437, 438, 453.1, 453.11
See application file for complete search history.

(56) References Cited

U.S. PATENT DOCUMENTS 3,550,417 A * 12/1970 McMaster ..... 72/57
3,572,080 A * 3/1971 Alexoff et al. ..... 72/273.5
3,585,832 A * 6/1971 Hinshaw et al. ..... 72/256
3,707,866 A * 1/1973 Brauer ..... 72/407
3,818,799 A * 6/1974 Hague ..... 72/438
4,131,164 A * 12/1978 Hague et al. ..... 72/438
4,197,757 A * 4/1980 Hackett ..... 72/264
6,212,929 B1 4/2001 Binhack

FOREIGN PATENT DOCUMENTS

DE 100 27 703 12/2001
WO WO-99/08813 2/1999
WO WO-2006/024505 3/2006

* cited by examiner

*Primary Examiner* — David Jones
(74) *Attorney, Agent, or Firm* — Rabin & Berdo, PC

(57) ABSTRACT

The present invention relates to a device for forming, in particular for cold forming, here in particular for cold extruding, a workpiece, which device has a forming die and a feed device by means of which a relative movement can be generated between the workpiece and the forming die, wherein the device has a frequency generating device which interacts with the feed device and by which the relative movement between the workpiece and the forming die, as generated by the feed device, can be modulated in such a way that following a forward stroke in which the workpiece and/or the forming die pass through a first stroke travel in the feeding direction, a movement of the forming die and/or of the workpiece can be effected in a subsequent reverse stroke, over a second stroke travel in a direction opposite to the feeding direction, and to a method for forming a workpiece wherein a relative movement between the workpiece and a forming die is generated by a feed device, which relative movement between the workpiece and the forming die, produced by the feed device, is modulated in such a way that following a forward stroke in which the workpiece and/or the forming die pass through a first stroke travel, a movement of the forming die and/or of the workpiece can be effected in a subsequent reverse stroke, over a second stroke travel in a direction opposite to the feeding direction.

10 Claims, 1 Drawing Sheet

DEVICE AND METHOD FOR FORMING A WORKPIECE

The present invention relates to a device for forming, in particular for cold forming, here in particular for cold extruding, a workpiece, which device has a forming die and a feed device by means of which a relative movement can be generated between the workpiece and the forming die, wherein the device has a frequency generating device which interacts with the feed device and by which the relative movement between the workpiece and the forming die, as generated by the feed device, can be modulated in such a way that following a forward stroke in which the workpiece and/or the forming die pass through a first stroke travel in the feeding direction, a movement of the forming die and/or of the workpiece can be effected in a subsequent reverse stroke, over a second stroke travel in a direction opposite to the feeding direction, and to a method for forming a workpiece wherein a relative movement between the workpiece and a forming die is generated by a feed device, which relative movement between the workpiece and the forming die, produced by the feed device, is modulated in such a way that following a forward stroke in which the workpiece and/or the forming die pass through a first stroke travel, a movement of the forming die and/or of the workpiece can be effected in a subsequent reverse stroke, over a second stroke travel in a direction opposite to the feeding direction.

A device and a method of that kind are known from EP 1 003 616 B1 to Applicant. Devices and methods of that kind are used, for example, for forming toothings on shafts or similar parts. In the case of solid shafts, the known device and the known method are capable of producing external toothings while in the case of tubular shafts both external and internal toothings can be formed. The device described by the before-mentioned printed publication and the corresponding method provide the advantage that the frequency-modulated feed allows the pressing force to be reduced by up to approximately 50%, compared with a conventional axial molding or extrusion operation.

However, there remains the basic problem with the known device and the known method that at the beginning of the structure to be produced (the toothing) a tip circle and/or a diameter formed will always be a little smaller than the area of the workpiece following that initial area in the direction of feed. This is due to the flow behavior of the material to be formed, and is a disadvantage especially for parts with very closely toleranced dimensions. A further problem encountered in producing structures on or in shaft-like parts resides in what is known as the bow wave, which will be encountered after the forming operation in the run-out area of the structure, especially when the structure ends by an undercut.

The device and the method described at the outset are further connected with the disadvantage that as a rule the forming die has an unsatisfactory service life. This is due to the fact that during the entire forming operation of the known device and the known method, a uniform forward stroke and a uniform reverse stroke are passed in each forming step, which means that the stroke travels in forward and in reverse direction always have the same length. With the result that it is always the same areas of the forming die that come to interact with the workpiece to be worked.

Now, it is the object of the present invention to improve a device and a method of the kind mentioned at the outset so that an improvement of the forming result and/or of the service life of the forming die will be achieved.

This object is achieved according to the invention by the fact that the frequency generating device modulates the feed device in such a way that the stroke travels of the forward strokes and/or of the reverse strokes of at least two successive forming steps of the device, each being composed of a forward stroke and a reverse stroke, are different.

The method according to the invention provides that the feed device is modulated by the frequency generating device in such a way that the stroke travels of the forward strokes and/or of the reverse strokes of at least two successive forming steps, each being composed of a forward stroke and a reverse stroke, are different.

The measures proposed by the invention now have the effect, on the one hand, that the service life of the forming die can be improved: Due to the different stroke travels of the successive individual forming steps the impact of the forces acting on the forming zones of the forming die will be different in each forming step, compared with the previous forming step. This has the result that the respective zones of the tool will not be loaded continuously—as in the case of the known devices and methods—but that the respective loads (thrust force, tensile force and bending load as well as abrasive load) will be advantageously distributed over different areas of the forming die. This advantageously leads to an improved service life. On the other hand, the measures proposed by the invention also permit the forming steps to be adapted adequately to the particular working requirements according to the particular situation so that a higher working quality can be achieved.

One advantageous further development of the invention provides that the forming steps passed by the forming die within a defined forming length, which the forming die is to run through in forming the workpiece, show a non-continuous chaotic distribution of the stroke travels of the different forming steps. This measure provides the advantage that it clearly increases the service life of the forming die because the way in which the forces act on the forming zones of the forming die differ a little for each forming step, compared with the preceding forming step, so that the different loads acting on the forming die when working a workpiece will likewise be distributed chaotically with the result that instead of constantly loading always the same forming zones, the loads will come to act on different forming zones of the forming die.

Another advantageous further development of the invention provides that the frequency generating device modulates the feed device in such a way that the forming path passed by the forming die in axial direction of the workpiece when working a workpiece is subdivided into at least two forming zones with different stroke travels of the forward stroke and/or of the reverse stroke of the different forming steps. That measure advantageously allows the individual forming steps to be adapted to the particular forming conditions encountered in a given forming zone, which means that the stroke travels of a given sequence of forming steps can be determined in such a way that the best possible working results will be achieved in a given forming zone.

Further advantageous developments of the invention are the subject-matter of the sub-claims.

Further details of the invention will be apparent from the embodiments that will be described hereafter by reference to the drawings in which.

Figure 1:
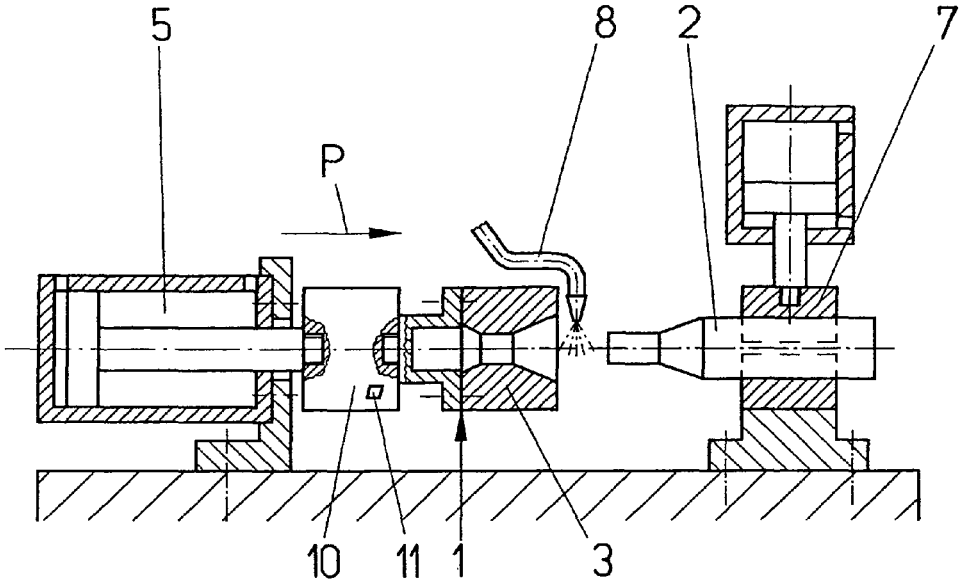
FIG. 1 shows a first embodiment of a device.

The first embodiment, illustrated in FIG. 1, of a device 1 for forming, in particular for cold forming, here in particular for cold extruding, a workpiece 2 comprises a forming tool 3, designed in the illustrated case as a forming die. The forming die can be displaced relative to the workpiece 2 by a feed device 5. The latter effects a relative movement between the forming die 3 and the workpiece 2 clamped in a clamping unit 7. When the forming die 3 is displaced in the feeding direction P against the workpiece 2, which latter is clamped in stationary condition in the present case, the workpiece 2 is caused to enter the forming die 3 for being formed in the manner known as such.

Now, the arrangement of the device 1 is such that the movement in the feeding direction P is modified by a frequency generating device 10 acting on the feed device 5 in such a way that the forming die 3 is caused to perform a stroke-like movement in the feeding direction P, which movement comprises an initial forward stroke by which the forming die 3 is moved in forward direction over a first stroke travel, whereafter the forming die 3 is withdrawn by the feed device 5 over a second stroke travel, by a subsequent reverse stroke. The forming die 3 is then moved forward again, by another first stroke travel of the next forming step following the one described before, beyond the end position of the forward stroke of the preceding forming step. This sort of hammering impact of the forming die 3 on the workpiece 2 has the advantageous effect that before the forming die 3 hits upon the area of the workpiece 2 that is to be worked by the next forming step, it has a kinetic energy higher than the one that would be reached if the force was applied continuously. A device of that kind has been known from EP 1 003 616 B1 to Applicant so that there is no need to describe it here in more detail.

As regards the further constructional configuration of the device 1 and its operation, reference is made to the before-mentioned European Patent Specification and its disclosure is incorporated herein by reference.

The device 1 to be described here now provides that the stroke travels of the forward strokes and/or the reverse strokes of the individual forming steps differ one from the other. This is the essential difference compared with the device and the corresponding method known from EP 1 003 616 B1 that have been described above where the forward strokes and the reverse strokes of the different forming steps all had identical stroke travels. Proceeding in such a way now results in substantial advantages with respect to production quality and/or service life of the forming die 3:

According to a preferred first embodiment, the stroke travel of the forward strokes and/or of the reverse strokes of the different forming steps shows a non-continuous chaotic distribution. It is preferred in this case that the frequency generating device 10 comprises what is known as a fuzzy logic 11 for determination of the respective forward strokes and/or reverse strokes of the individual forming steps.

That way of proceeding provides the advantage of leading to a clear improvement of the service life of the forming die 3 due to the fact that the impact of the force on forming zones of the forming die 3 will be somewhat different for each forming step, compared with the preceding forming step: The loads acting on the forming die 3 (in particular thrust force, tensile force and bending load as well as abrasive load) in forming the workpiece 2 show an equally chaotic distribution, due to the non-continuous chaotic succession of the stroke travels of the individual forward strokes and/or reverse strokes of the different forming steps, so that the distribution of the loads acting on the forming die 3 will be chaotic as well.

Accordingly, it is preferred that the fuzzy logic 11 of the frequency generating device 10 should program the forward strokes and/or the reverse strokes of the different forming steps in such a way that substantially no identical stroke travels will be encountered in one axial forming length of the workpiece 2. The advantage of this way of proceeding lies in the fact that it allows the loads acting on the forming die 3 to be distributed.

The way of proceeding described above is also suited for use in removing the workpiece 2 from the forming die 3. The procedure to be followed for this purpose becomes obvious to the man of the art if he simply regards the reverse direction of the forming die 3 as the "forward direction" in the meaning of the above explanations.

According to a second preferred further development of the operating principle of the device 1 the frequency modulation of the feed device 5 is carried out in such a way that the forming path passed by the forming die 3 in working the workpiece 2 in its axial direction is subdivided into at least two forming zones and that the stroke travel of the forward strokes and/or of the reverse strokes of the forming steps correlated to the respective forming zone is suitably defined within that forming zone so as to achieve an improved forming behavior of the forming die 3: For example, in order to counteract the before-mentioned problems encountered in forming the tip circle of a toothing, it is now provided that when forming the workpiece 2 in that forming zone, the frequency modulation of the feed device 5 by a frequency generating device 10 is effected in a way to ensure that the good material flow otherwise desired for forming operations is intentionally prevented or at least reduced. This results in improved filling of the tip circle for both internal and external toothings. And in the case of necked-in portions, dipping away of the diameter of the workpiece 2 to be formed is also prevented or at least reduced in this way.

After that first forming zone has been formed, the forming operation is then preferably continued, in the next following forming zone, in the manner described before using non-continuous chaotic modulation of the forming tool 3.

That way of proceeding is of course not limited to two forming zones. In principle, any desired number of different forming zones may be provided in order to adequately adapt the length of the forward strokes and/or of the reverse strokes of the forming steps, correlated to the particular forming zone, to the working requirements and/or the working results to be achieved in the particular situation. In order to prevent or to reduce the before-described "bow wave" it is possible, for example, to provide that the feed device 5 will be modulated by the frequency generating device 10 at the end of the forming travel to be passed by the forming die 3 in such a way that the forming die 3 will perform a very small stroke travel in forward direction and an even smaller stroke travel in reverse direction in the respective forming steps so that no material, or at least a reduced amount of material, will be pushed beyond the end portion of the toothing.

Figure 2:
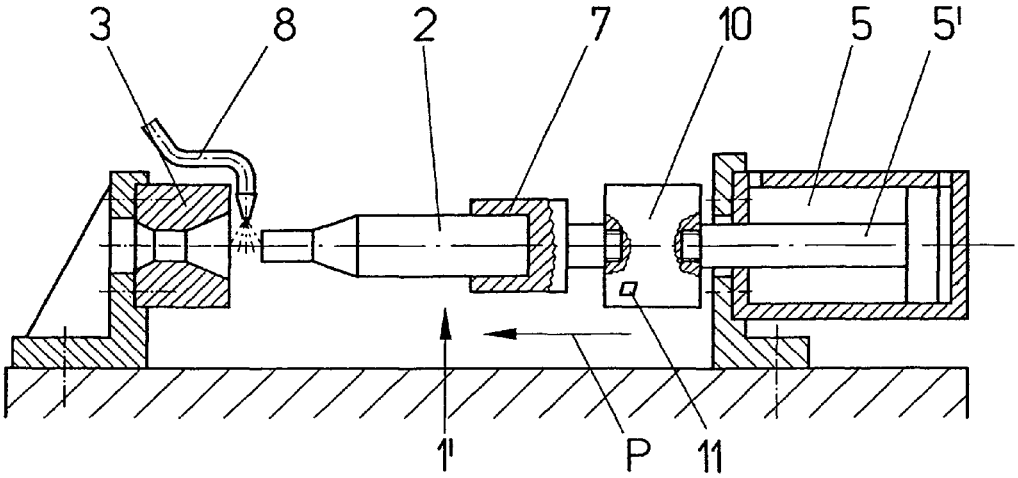
FIG. 2 shows a second embodiment of a device.

The embodiment of a device 1' illustrated in FIG. 2 conforms substantially to the device 1 of the first embodiment so that identical parts can be indicated by the same reference numerals and need not be described here in greater detail. One essential difference between the two embodiments is seen in the fact that in the case of the device 1 the forming die 3 is stationary while the workpiece 2 can be displaced in axial direction relative to the forming die 3. Accordingly, the feed device 5, and the frequency generating device 10 coacting with it, act on the workpiece 2 or on the clamping unit 7 by which the workpiece 2 is clamped.

Combining the two before-mentioned embodiments is of course also possible, which means that both the forming die 3 and the workpiece 2 may be displaced by the feed device 3 for producing a corresponding relative movement between the workpiece 2 and the forming die 3.

The invention claimed is:

1. Device for forming a workpiece, which device has a forming die and a feed device by means of which a relative movement can be generated between the workpiece and the forming die, wherein the device has a frequency generating device which interacts with the feed device and by which the relative movement between the workpiece and the forming die, as generated by the feed device, can be modulated in such a way that following a forward stroke in which at least one of the workpiece and forming die pass through a first stroke travel in the feeding direction, a movement of at least one of the forming die and the workpiece can be effected in a subsequent reverse stroke, over a second stroke travel in a direction opposite to the feeding direction, characterized in that the frequency generating device modulates the feed device in such a way that at least one of the stroke travels of the forward strokes and the reverse strokes of at least two successive forming steps of the device, each being composed of a forward stroke and a reverse stroke, are different.

2. The device as defined in claim 1, wherein the frequency generating device includes a control element with fuzzy logic.

3. The device as defined in claim 1, wherein the forming steps carried out within a defined forming length, which the forming die is to run through in forming the workpiece, show a non-continuous chaotic distribution of the stroke travels of the different forming steps.

4. The device as defined in claim 1, wherein the frequency generating device modulates the feed device in such a way that the forming path passed by the forming die in axial direction of the workpiece when working the workpiece is subdivided into at least two forming zones with different stroke travels of at least one of the forward stroke and of the reverse stroke of the different forming steps.

5. The device as defined in claim 1, wherein the device is a device for the cold forming of a workpiece.

6. Method for forming a workpiece wherein a relative movement between the workpiece and a forming die is generated by a feed device, which relative movement between the workpiece and the forming die, produced by the feed device, is modulated in such a way that following a forward stroke in which at least one of the workpiece and the forming die pass through a first stroke travel in the feed direction, a movement of at least one of the forming die and the workpiece, effected in a subsequent reverse stroke over a second stroke travel in a direction opposite to the feeding direction, is modulated by a frequency generating device in such a way that the stroke travels of at least one of the forward strokes and the reverse strokes of at least two successive forming steps, each being composed of a forward stroke and a reverse stroke, are different.

7. The method as defined in claim 6, wherein the frequency generating device used is a frequency generating device with fuzzy logic.

8. The method as defined in claim 6, wherein the frequency generating device generates a succession of non-continuous chaotic forming steps.

9. The method as defined in claim 6, wherein the feed device is modulated by the frequency generating device in such a way that the forming path passed by the forming die in an axial direction of the workpiece when working the workpiece is subdivided into at least two forming zones with different stroke travels of the forward stroke and the reverse stroke of the different forming steps.

10. A device for forming a workpiece, the device comprising:

a forming die;

a feed device by which a relative movement can be generated between the workpiece and the forming die; and a frequency generating device that interacts with the feed device and by which the relative movement between the workpiece and the forming die, as generated by the feed device, is modulated in such a way that following a forward stroke in which at least one of the workpiece and forming die pass through a first stroke travel in the feeding direction, a movement of at least one of the forming die and the workpiece is effected in a subsequent reverse stroke, over a second stroke travel in a direction opposite to the feeding direction;

wherein the frequency generating device modulates the feed device in such a way that at least one of the stroke travels of the forward strokes and the reverse strokes of at least two successive forming steps of the device, each being composed of a forward stroke and a reverse stroke, are different; and wherein the frequency generating device includes a control element with fuzzy logic.

* * * * *